US009765574B2

(12) United States Patent
Slaughter, Jr. et al.

(10) Patent No.: US 9,765,574 B2
(45) **Date of Patent: *Sep. 19, 2017**

(54) DUAL-MEMBER PIPE JOINT FOR A DUAL-MEMBER DRILL STRING

(71) Applicant: The Charles Machine Works, Inc., Perry, OK (US)

(72) Inventors: Greg Lowell Slaughter, Jr., Perry, OK (US); Cody L. Sewell, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 948 days.

This patent is subject to a terminal disclaimer.

(21) Appl. No.: 13/951,797

(22) Filed: Jul. 26, 2013

(65) Prior Publication Data

US 2014/0027184 A1 Jan. 30, 2014

Related U.S. Application Data

(60) Provisional application No. 61/676,049, filed on Jul. 26, 2012.

(51) Int. Cl.

| | |
|---|---|
| ***E21B 17/00*** | (2006.01) |
| ***E21B 7/04*** | (2006.01) |
| ***E21B 7/20*** | (2006.01) |
| ***E21B 17/18*** | (2006.01) |

(52) U.S. Cl.

CPC ..... *E21B 17/00* (2013.01); *E21B 7/046* (2013.01); *E21B 7/20* (2013.01); *E21B 17/18* (2013.01)

(58) Field of Classification Search

CPC ..... E21B 17/00; E21B 17/02; E21B 17/042; E21B 19/18; E21B 7/046; E21B 7/20; E21B 17/18

See application file for complete search history.

(56) References Cited

U.S. PATENT DOCUMENTS

| | | | |
|---|---|---|---|
| 5,490,569 | A | 2/1996 | Brotherton et al. |
| 5,682,956 | A | 11/1997 | Deken et al. |
| 6,659,202 | B2 | 12/2003 | Runquist et al. |
| RE38,418 | E | 2/2004 | Deken et al. |
| 7,025,152 | B2 | 4/2006 | Sharp et al. |
| 7,216,724 | B2 | 5/2007 | Self et al. |
| 7,389,831 | B2 | 6/2008 | Mullins et al. |
| 7,694,753 | B2 | 4/2010 | Carlson et al. |
| 8,201,644 | B2 | 6/2012 | Hall et al. |

(Continued)

*Primary Examiner* — Yong-Suk (Philip) Ro

(74) *Attorney, Agent, or Firm* — Tomlinson McKinstry, P.C.

(57) ABSTRACT

A torque-transmitting connection for a dual-member drill string. An elongate inner ember of a dual-member pipe is disposed within an outer member and rotatable independent of the outer member. The inner member comprises a geometrically-shaped pin end and a box end having a geometrically-shaped opening. The geometrically-shaped opening of the box end has at least one internal angle greater than 180 degrees. The pin end of the inner member may be inserted into the box end of an adjacent similarly formed inner member to form an inner member pipe joint. The configuration of the pin end and the box end allows the pin end and the box end to be in connector free torque-transmitting engagement but also provides clearance for potential misalignment of the pin end and the box during make-up of an inner member drill string.

23 Claims, 9 Drawing Sheets

(56) References Cited

U.S. PATENT DOCUMENTS

| | | | | |
|---|---|---|---|---|
| RE44,427 | E | 8/2013 | Runquist et al. | |
| 8,534,388 | B2 | 9/2013 | Hall et al. | |
| 2005/0103527 | A1* | 5/2005 | Church | E21B 7/068 175/62 |
| 2014/0102799 | A1 | 4/2014 | Stringer et al. | |

* cited by examiner

DUAL-MEMBER PIPE JOINT FOR A DUAL-MEMBER DRILL STRING

CROSS REFERENCE TO RELATED APPLICATION

This application claims the benefit of provisional patent application Ser. No. 61/676,049, filed on Jul. 26, 2012, the entire contents of which are incorporated herein by reference.

FIELD OF THE INVENTION

The present invention relates generally to boring machines and specifically to boring machines using dual-member drill strings and to methods of boring horizontal boreholes using dual-member drill strings.

SUMMARY OF THE INVENTION

The present invention is directed to a pipe section for use in drill strings in rotary boring applications. The pipe comprises an elongate, hollow outer member having a pin end and a box end, wherein the pin end and the box end are correspondingly formed for torque-transmitting engagement. The pipe further comprises an elongate inner member disposed within the outer member and rotatable independently of the outer member. The inner member comprises a geometrically-shaped pin end, and a box end having a geometrically-shaped opening comprising at least one internal angle greater than 180 degrees. The pin end is slidably receivable in connector free torque-transmitting engagement with the box end of a similarly formed inner member.

The present invention is also directed to an elongate inner member section of a dual-member drill string. The elongate inner member comprises a geometrically-shaped pin end, and a box end having a geometrically-shaped opening comprising at least one internal angle greater than 180 degrees. The pin end is slidably receivable in connector free torque-transmitting engagement with the box end of a similarly formed inner member section.

The present invention is further directed to a horizontal boring system comprising a rotary drilling machine and a drill string having a first end and a second end. The first end of the drill string is operatively connectable to the rotary machine to drive rotation of the drill string. The drill string comprises a plurality of pipe sections. Each pipe section comprises an elongate, hollow outer member having a pin end and a box end, wherein the pin end and the box end are correspondingly formed. The pipe further comprises an elongate inner member disposed within the outer member and rotatable independently of the outer member. The inner member comprises a geometrically-shaped pin end, and a box end having a geometrically-shaped opening comprising at least one, internal angle greater than 180 degrees. The pin end is slidably receivable in connector free torque-transmitting engagement with the box end of an adjacent similarly formed inner member.

The present invention is also directed to a method for drilling a generally horizontal borehole using a dual-member drill string comprising a plurality of dual-member pipe sections, each dual-member pipe section having an inner member comprising a geometrically-shaped pin end and a box end having a geometrically-shaped opening comprising at least one internal angle greater than 180 degrees, the inner member being disposed within an outer member comprising a pin end and a box end. The method comprises the steps of sliding the geometrically-shaped pin end of the inner member into the geometrically-shaped opening of the box end of a like inner member, and orienting the geometrically-shaped pin end of the inner member such that the geometrically-shaped pin end engages with at the least one internal angle greater than 180 degrees of the box end of the like inner member. The method further comprises the step of connecting the pin end of the outer member with the box end of a like outer member.

DESCRIPTION OF THE PREFERRED EMBODIMENT

Horizontal directional drills or boring machines may be used to replace underground utilities with minimal surface disruption. The horizontal directional drills may utilize single member drill strings or dual-member drill strings to create the desired borehole. Drilling machines that use dual-member drill strings are generally considered "all terrain" machines because they are capable of drilling through soft soil as well as rocks and rocky soil. Dual-member drill strings comprise a plurality of dual member pipe sections. Each dual member pipe section comprises an inner member supported inside an outer member. The inner member is generally rotatable independent of the outer member. The inner member may be used to rotate the drill bit to excavate the formation, and the outer member is selectively rotated to align a steering mechanism to change the direction of the borehole while the rotating bit continues to drill. One such, system is described in U.S. Pat. No. 5,490,569, entitled Directional Boring Head With Deflection Shoe, the contents of which are incorporated herein by reference. A suitable dual-member drill string for use in, horizontal directional drilling is disclosed, in U.S. Pat. No. RE38,418, entitled Dual Member Pipe Joint For A Dual Member Drill String, the contents of which are incorporated herein by reference.

One method to connect dual member drill strings is by threading the inner members together and threading the outer members together. Another method is to connect the outer members using a threaded connection and connect the inner member using a non-threaded connection. This may be done by forming the ends of the inner members in a non-threaded geometric shape, such that the geometric-shape of the box end of the inner member corresponds with the geometric-shape of the pin end of a second inner member. The pin end of the inner member may slide axially into the box end of the second inner member to form a connector-free, torque-transmitting connection. In order to make this connection, the pin end and the box end should be aligned before sliding the pin end into the box end. If the pin end and the box end are not aligned, the makeup process may be delayed thus delaying drilling operations. Therefore, there remains a need for improved drill strings for use in horizontal directional drilling operations.

The present invention provides a connector-free, torque-transmitting connection for the inner members of a dual member drill string. The present invention allows for connection of the pin end and the box end of the inner member, while misaligned, during make-up of the dual member drill string.

Figure 1:
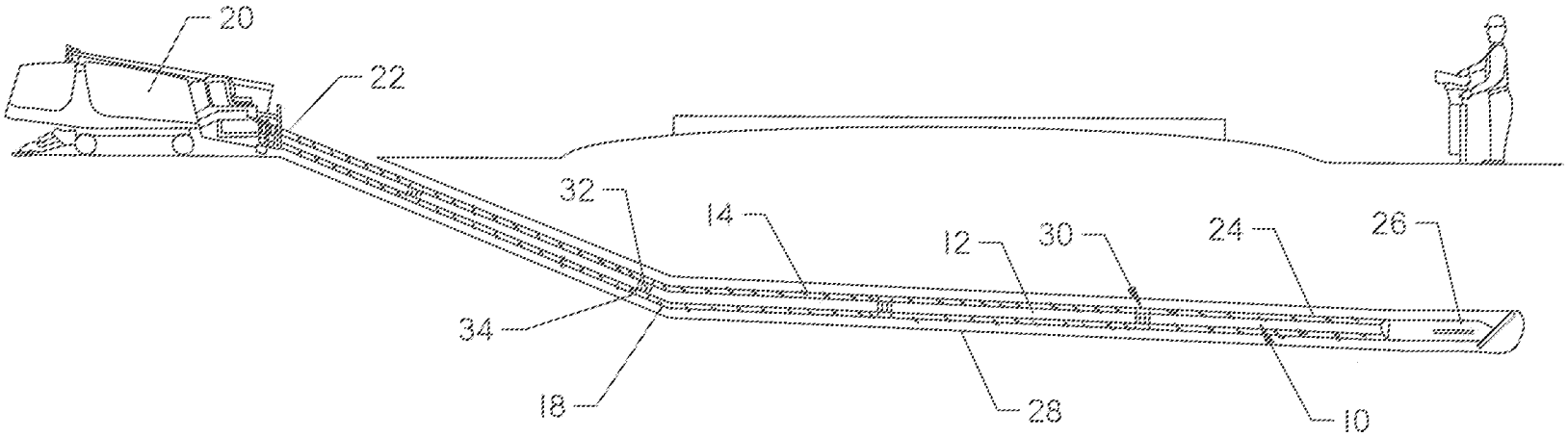
FIG. 1 is a diagrammatic representation of a horizontal directional drilling operation showing a cut-away view of the dual member drill string of the present invention.

Turning now to FIG. 1 there is shown therein a typical horizontal directional drilling operation. FIG. 1 depicts the use of a dual member drill string 10. In FIG. 1, the dual member drill string 10 is shown in a cut-away view and comprises an elongate inner member 12 disposed within an elongate, outer member 14. The dual member drill string 10 is made by connecting a plurality of dual member pipe sections 18 together to form a dual-member pipe joint 30. The dual member pipe joint 30 comprises an inner member pipe joint 32 and an outer member pipe joint 34. The dual member pipe sections 18 are connected together at the ground surface utilizing a rotary boring machine 20. The dual member drill string 10 further comprises a first end 22 and a second end 24. The first end 22 of the dual member drill string 10 is operatively connected to the rotary boring machine 20 to rotate and thrust the drill string. The second end 24 of the dual member drill string 10 is connected to a downhole tool which may comprise a directional boring head 26. The directional boring head 26 is used to bore a borehole 28 through the ground with directional control.

Figure 2:
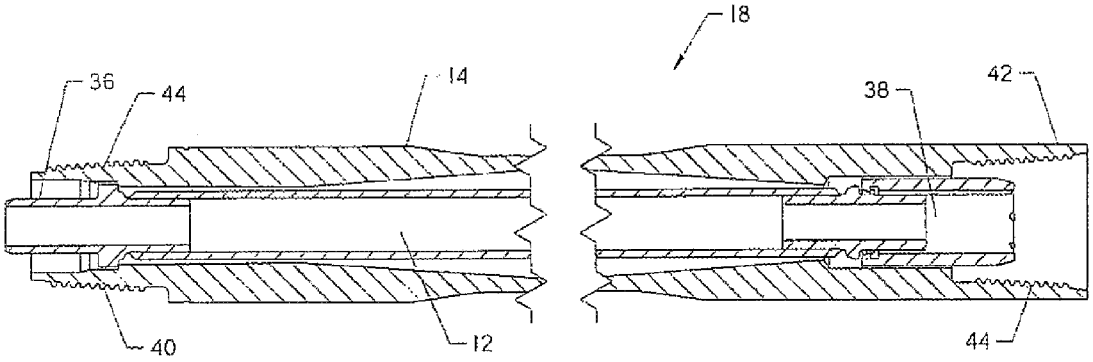
FIG. 2 is an illustration of one embodiment of a dual member pipe section from the dual-member drill string shown in FIG. 1.

With reference now to FIG. 2, a dual member pipe section 18 from the dual member drill string 10, shown in FIG. 1, is shown in more detail. The inner member 12 is disposed generally coaxially within the outer member 14 and is rotatable independently from the outer member. The inner member 12 comprises a pin end 36 and a box end 38 and may be either solid or comprise a central bore. Similarly, the outer member 14 is hollow and comprises a pin end 40 and a box end 42. As shown, the box end 38 of the inner member 12 may be positioned within the box end 42 of the outer member 14. Similarly, the pin end 36 of the inner member 12 may be positioned within the pin end 40 of the outer member 14. However, one skilled in the art will recognize that the inner member 12 may be positioned so that the pin end 36 of the inner member is within the box end 42 of the outer member 14, as shown in FIG. 3.

Continuing with FIG. 2, the pin end 36 of the inner member 12 may be engaged with the box end 38 of an adjacent similarly formed inner member 12, forming the inner member pipe joint 32, as shown in FIG. 1. Similarly, the pin end 40 of the outer member 14 may be engaged with the box end 42 of an adjacent correspondingly formed outer member 14, forming the outer member pipe joint 34, as shown in FIG. 1. These connections or engagements together form the dual-member pipe joint 30. The dual member drill string 10 is formed by creating a plurality of like dual-member pipe joints 30.

The construction of the pin end 36 and the box end 38 of the inner members 12, described herein, allows for single-action, "slip-fit" connection, or "connector-free" engagement of adjacent inner pipes when making up the inner members 12 of the dual-member drill string 16. The pin end 40 of the outer member 14 and the box end 42 of an adjacent outer member 14 may be connected by corresponding threads 44, as shown in FIG. 2. During operation, the pin end 36 of the inner member 12 and the pin end 40 of the outer member 14 of each dual-member pipe section 18 may be substantially simultaneously engageable to the box end 38 of the inner member 12 and the box end 42 of the outer member 14 of an adjacent similarly formed dual-member pipe section 18. The inner member 12 may also be made up before the outer member 14.

Figure 3:
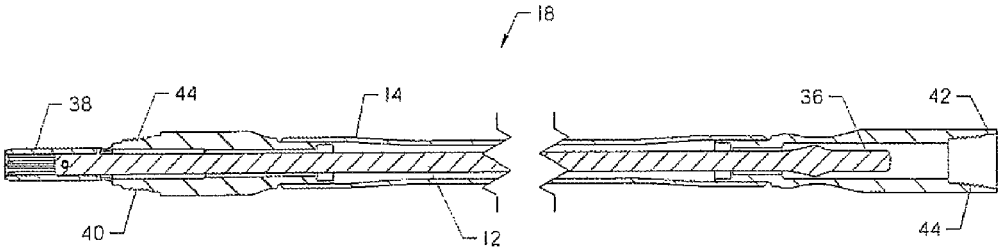
FIG. 3 is an illustration of an alternative embodiment of the dual member pipe section from the dual-member drill string shown in FIG. 1.

Turning now to FIG. 3, an alternative embodiment of the dual member pipe section 18 is shown. The alternative embodiment provides for a longer dual member pipe section 18 which may be desired in some dulling operations. In FIG. 3, the pin end 36 of the inner member 12 is shown positioned within the box end 42 of the outer member 14 and the box end 38 of the inner member is shown positioned proximate the pin end 40 of the outer member. In this embodiment, the pin end 36 of the inner member 12 and the box end 42 of the outer member 14 may also be substantially simultaneously engageable to the box end 38 of an adjacent similarly formed inner member and to the pin end 40 of an adjacent similarly formed outer member.

Figure 4:
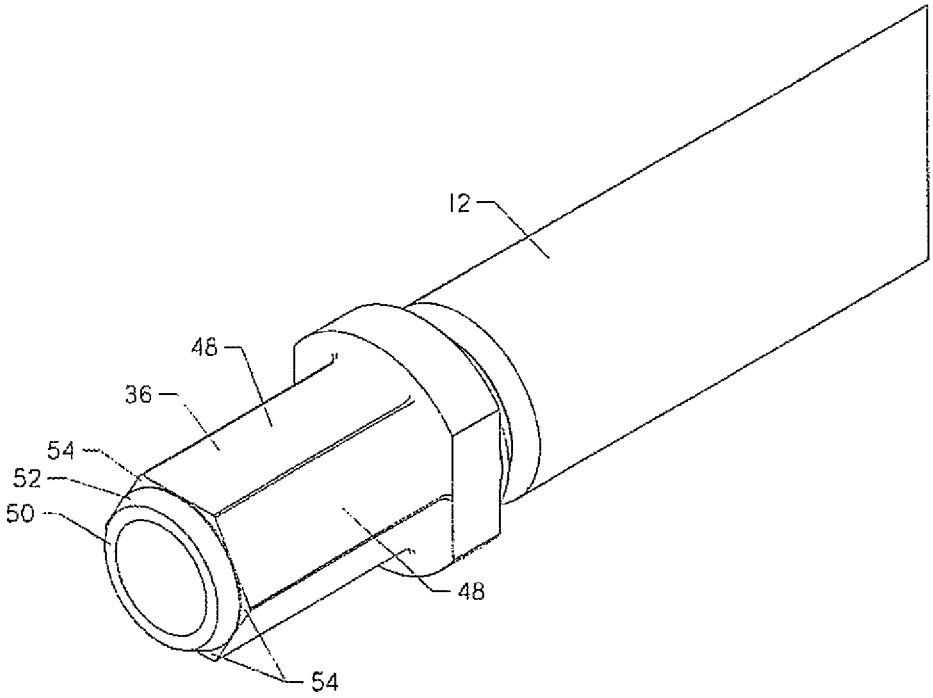
FIG. 4 is a perspective view of one embodiment of the pin end of the inner member of the dual member pipe section shown in FIG. 2.

Turning to FIG. 4, a perspective view of one embodiment of the pin end 36 of the inner member 12 is shown. The pin end 36 may comprise a geometric shape formed by a plurality of flat sides 48; preferably, the plurality of flat sides form a hexagon, as shown in FIG. 4. Any geometrical shape which works to transmit torque will suffice. However, it will be understood that for purposes of this application, "geometrically shaped" does not include a circular shape that would not allow torque transmission from one joint to the next.

Continuing with FIG. 4, the pin end 36 further comprises a front end 50. A frustoconical guide 52 is formed on the front end 50 of the pin end 36. The largest circumference of the frustoconical guide 52 is smaller than the smallest circumference of the plurality of flat sides 48. Due to this, the ends of the plurality of flat sides 48 form a plurality of alignment projections 54 that extend past the frustoconical guide 52. The alignment projections 54 aid alignment of the geometric feature of the pin end 36 with the geometric feature of the box end 38 of the inner members 12 to form the inner member pipe joint 32 (FIG. 1). This helps to lessen the likelihood that the pin end 36 will engage the box end 38 while misaligned, thus lowering potential hoop stress on the inner member pipe joint 32.

Figure 5:
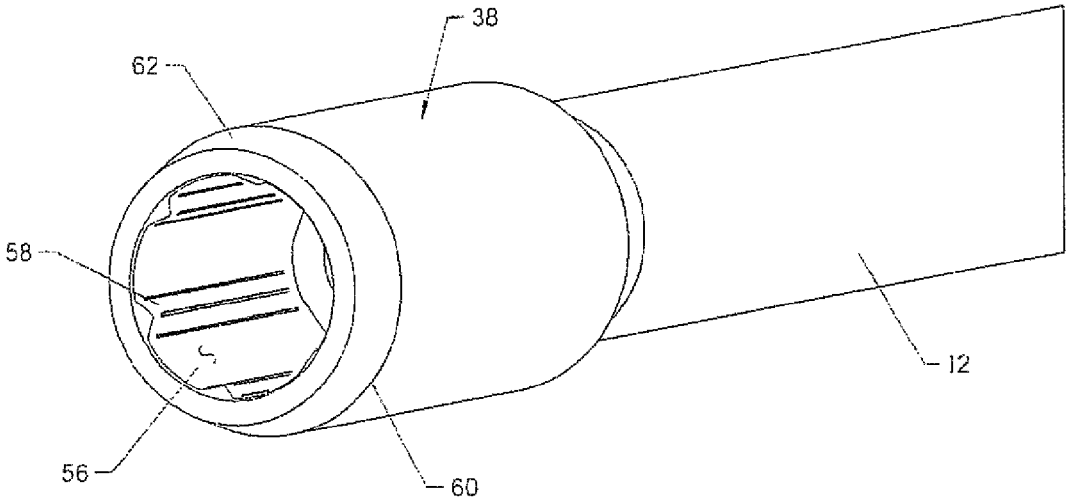
FIG. 5 is a perspective view of a box end of the inner member of the dual member pipe section shown in FIG. 2.

Turning to FIG. 5, the box end 38 of the elongate inner member 12 is shown in greater detail. The box end 38 comprises a central opening 56 having a geometric shape 58. The box end 38 further comprises a front end 60. A tapered guide 62 may be inwardly formed at the front end 60 of the box end 38. The tapered guide 62 is complementary with the frustoconical guide 52 of the pin end 36 and helps to correctly align the pin end 36 and the box end 38 when the pin end is inserted into the box end.

Figure 6:
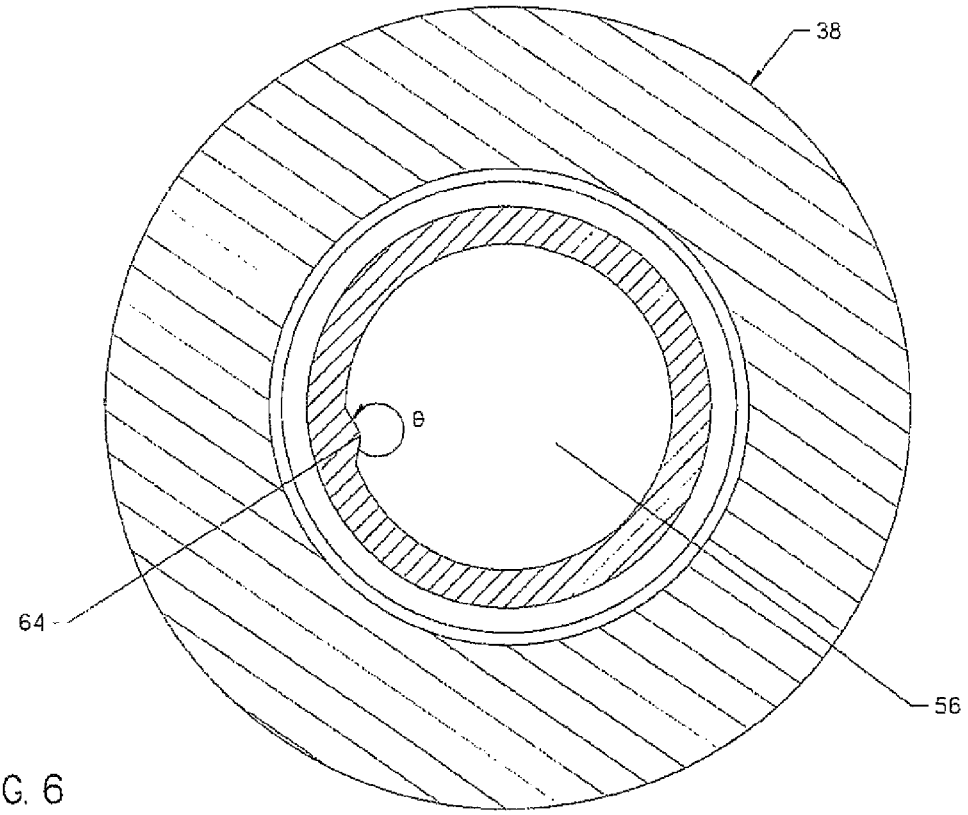
FIG. 6 is a cross-section view of one embodiment of the box end of the inner member.

Turning to FIG. 6, a cross-section view of one embodiment of the box end 38 of the inner member 12 is shown. The geometric shape of the box end 38 does not directly correspond with the geometric shape of the pin end 36 of the inner member 12. The geometric shape of the box end 38 comprises at least one internal angle Θ greater than 180 degrees forming an internal projection 64. The term internal angle refers only to angles that may be measured within the inner circumference of the central opening 56, as shown by the arrow in FIG. 6. FIG. 6 shows a geometric shape that comprises only one internal projection 64.

Figure 7:
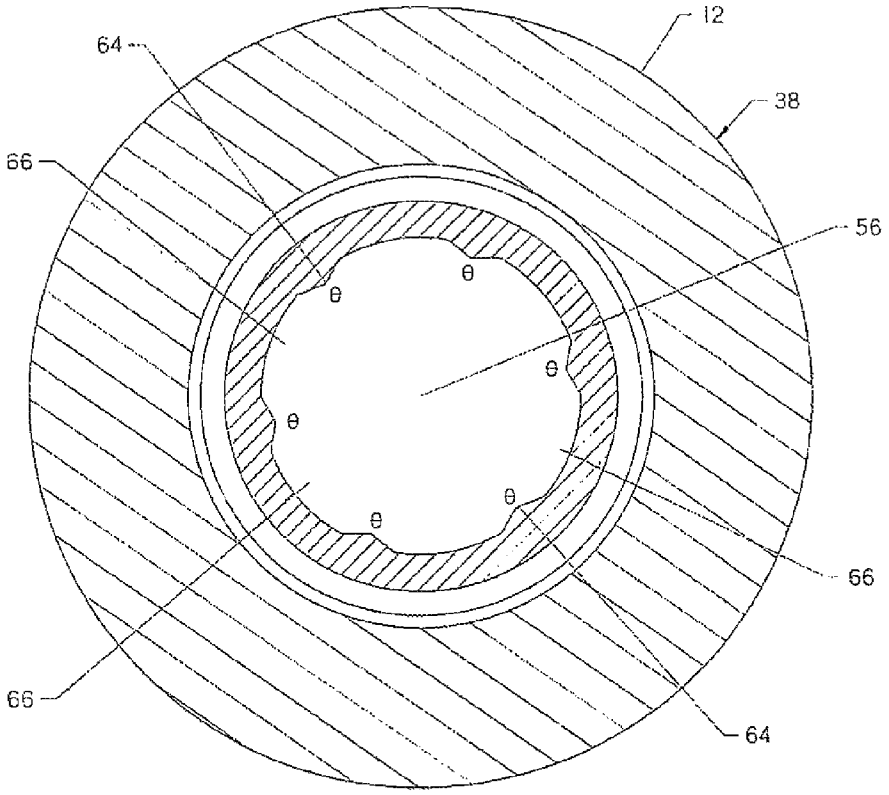
FIG. 7 is a cross-section view of an alternative embodiment of the box end of the inner member.
Figure 8:
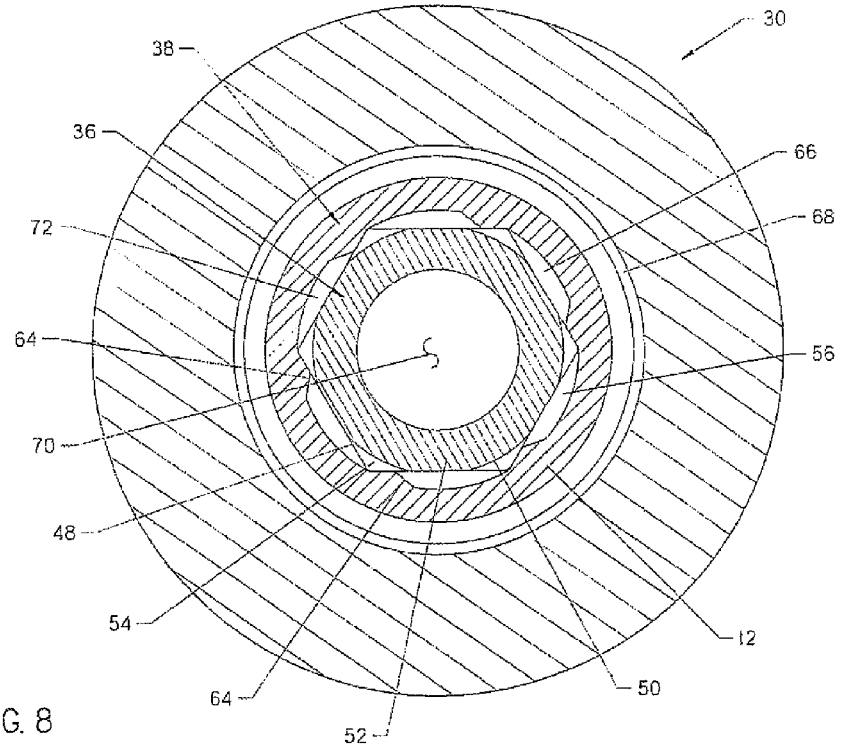
FIG. 8 is a cross-section view of the dual member pipe section showing the pin end of the inner member disposed within the box end of an adjacent inner member.
Figure 9:
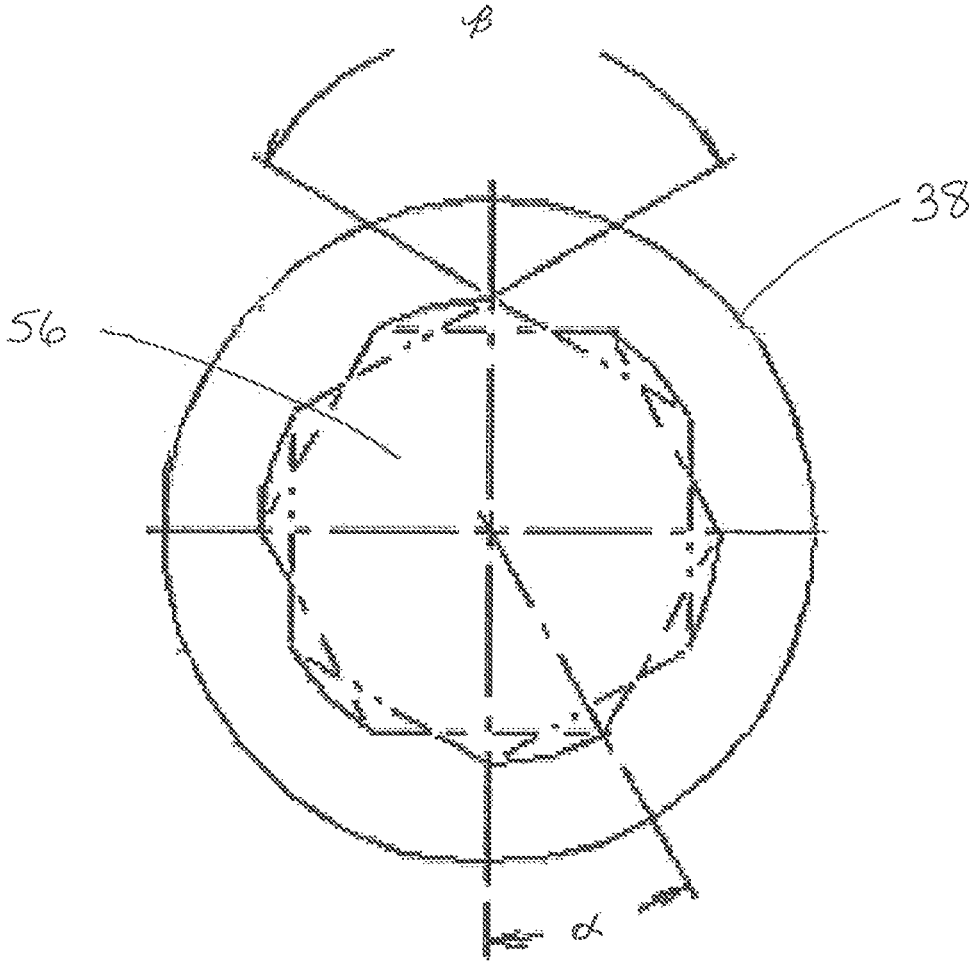
FIG. 9 is a cross section view of the box end of the inner member showing an opening in the box end having a shape formed by rotation of a pair of hexagons about a central angle of 30 degrees.

With reference to FIGS. 7-9, the box end 38 of the inner member 12 may be modified so that the central opening 56 has the shape of a twelve-point hexagon, wherein two hexagons are formed on the internal portion of the box end 38 with one of the hexagons oriented with an angular offset from the other hexagon. As shown in FIG. 9, the two hexagons are rotated about a central angle α. Angle α is one of a pair of vertical angles formed by a pair of intersecting lines that include adjacent sides of one of the hexagons. In the embodiment of FIG. 9, angle α is 30 degrees, and angle β is 120 degrees.

The points created by these two angularly offset hexagons may be modified by removing every other point, leaving six points of contact. This allows for the hexagon feature of the pin end 36 of the inner member 12 to be angularly misaligned with the corresponding feature of the box end 38 by 30 degrees or more and still engage the tool joint properly once torque is applied to the joint. Modifying the joint in this way allows a certain amount of backlash in the joint, caused by the clearance that is a result of removing six out of the twelve points. Preferably, the angular offset of one hexagon to another is controlled so that the greatest amount of misalignment can be allowed and still result in proper joint make-up. However, the minimum amount of engagement on the internal projections 64 is maintained to transmit the torque necessary through the connection. A chamfer can also be incorporated into the box end 38 to allow for correction of misalignment of the box end 38 and the pin end 36.

Turning to FIG. 7, a cross-section view of the box end 38 of the inner member 12 is shown comprising a plurality of internal projections 64. The geometric shape of the box end 38 may comprise the same number of internal projections 64 as corresponding flat sides 48 of the pin end 36 of the inner member 12 (FIG. 4). Thus, if the plurality of flat sides 48 form a hexagon, the geometric shape of the box end 38 will comprise six internal projections 64 formed from a plurality of internal angles Θ greater than 180 degrees, as shown in FIG. 7.

Continuing with FIG. 7, a plurality of spaces 66 are formed between the internal projections 64. The spaces 66 may be straight or curved. The spaces 66 between the internal projections 64 give the geometric shape 46 of the pin end 36 clearance to move once inserted into the box end 38 to engage the projections 64. The plurality of flat sides 48 of the geometric shape of the pin end 36 may shift until they contact the internal projections 64 of the box end 38, as seen in FIG. 8. Once the plurality of flat sides 48 engage the internal projections 64, the adjacent inner members 12 are capable of transferring torque to the newly connected inner member. Thus, the pin end 36 may be angularly misaligned with the box end 38 when make-up process begins and the pin end is initially slid into the box end.

If only one internal projection 64 is present, as shown in FIG. 6, the flat sides 48 may move or shift once initially slid into the box end 38 until at least one of the flat sides 48 contacts the internal projection 64. The internal projections 64 may be positioned as desired to allow the greatest amount of misalignment and still maintain sufficient torque-transmitting engagement between the adjacent inner members 12.

Referring now to FIG. 8, a cross-section of the dual member pipe joint 30 is shown. FIG. 8 shows the pin end 36 disposed with the alternative embodiment of the box end 38 shown in FIG. 7. The front 50 of the pin end 36 is shown within the central opening 56 of the box end 38. The frustoconical guide 52 and the alignment projections 54 of the pin end 36 are also shown within the central opening 56. An annular space 68 is shown between the inner member 12 and the outer member 14. Fluid may flow through the annular space 68 and down towards the directional boring head 26 (shown in FIG. 1) during drilling operations. The inner member 12 may also comprise a central bore 70, as shown in FIG. 8, or may comprise a solid rod. Fluid may also pass through the central bore 70 during drilling operations.

FIG. 8 also shows the geometric shape 58 of the box end 38 having six internal projections 64. Six flat sides 48 forming the geometrically-shaped pin end 36 are shown engaged with the projections 64. Six spaces 66 shown between the projections 64 provide clearance for the flat sides 48 to move or shift as needed to properly engage the internal projections. Torque-transmitting engagement between the pin end 36 and the box end 38 occurs when the flat sides 48 engage the internal projections 64. A plurality of passages 72 are created between the flat sides 48 and the spaces 66 when the flat sides are engaged with the internal projections 64. The passages 72 allow for additional space for fluid to flow through the drill string 16 and down towards the directional boring head during drilling operations (FIG. 1).

In operation, the geometrically-shaped pin end 36 of the inner member 12 will be slid into the geometrically-shaped opening of the box end 38 of an adjacent inner member. The geometrically-shaped pin end 36 will then be oriented such that it engages with at least one internal projection 64 formed from the at least one internal angle Θ greater than 180 degrees of the geometrically-shaped box end 38 of the adjacent inner member. The pin end 40 of the outer member 14 is subsequently or simultaneously connected to the box end 42 of an adjacent outer member. The outer members 14 may be connected by threading the pin end 40 of the outer member to the box end 42 of the outer member.

Various modifications can be made in the design and operation of the present invention without departing from its spirit. Thus, while the principal preferred construction and modes of operation of the invention have been explained in what is now considered to represent its best embodiments, it should be understood that within the scope of the appended claims, the invention may be practiced otherwise than as specifically illustrated and described.

What is claimed is:

1. A pipe section comprising:

an elongate, hollow outer member having a pin end and a box end, wherein the pin end and the box end are correspondingly formed for torque-transmitting engagement; and an elongate inner member disposed within the outer member and rotatable independently of the outer member, the inner member comprising:

a polygonal pin end;

a box end having an opening having a plurality of sides in which at least two adjacent sides form an included angle, measured within the opening, greater than 180 degrees and less than 360 degrees; and wherein the pin end is slidably receivable in connector free torque-transmitting engagement within a box end of an identical adjacent inner member.

2. The pipe section of claim 1 wherein the pin end of the inner member comprises a frustoconical guide.

3. The pipe section of claim 1 wherein the box end of the inner member is positioned within the box end of the outer member.

4. The pipe section of claim 1 wherein the pin end of the inner member comprises a plurality of flat sides and a plurality of projections, formed by the intersection of the flat sides.

5. The pipe section of claim 1 wherein the inner member comprises a central bore.

6. The pipe section of claim 1 in which the pin end of the inner member has a hexagonal shape.

7. The pipe section of claim 1 in which the included angle between the at least two adjacent sides of the box end's opening is 210 degrees.

8. The pipe section of claim 1 wherein the pin end and the box end of the outer member are correspondingly threaded for connection to adjacent outer members.

9. A horizontal boring system comprising:

a rotary drilling machine; and a drill string having a first end and a second end, the first end being operatively connectable to the rotary machine to drive rotation of the drill string, the drill string comprising:

a plurality of pipe sections, each comprising the pipe section of claim 1.

10. The horizontal boring system of claim 9 wherein the pin end of the inner member and the pin end of the outer member of each pipe section are substantially simultaneously engageable to the box end of the inner member and the box end of the outer member of another one of the plurality of pipe sections.

11. The horizontal boring system of claim 9 wherein the pin end of the outer member of each pipe section is engageable to the box end of the outer member of another one of the plurality of pipe sections so that the outer members of the plurality of pipe sections form a passageway extending the length of the drill string.

12. The horizontal boring system of claim 9 further comprising a directional boring head attached to the second end of the drill string.

13. The horizontal boring system of claim 9 wherein the pin end of the inner member comprises a frustoconical guide to direct the pin end of the inner member into the box end of an adjacent inner member.

14. The horizontal boring system of claim 9 wherein the box end of the inner member is positioned within the box end of the outer member.

15. The horizontal boring system of claim 9 wherein the pin end of the inner member comprises a plurality of flat sides and a plurality of projections, formed by the intersection of the flat sides.

16. The horizontal boring system of claim 9 wherein the inner member comprises a central bore.

17. The horizontal boring system of claim 9 in which the pin end of the inner member has a hexagonal shape.

18. The horizontal boring system of claim 9 in which the included angle between the at least two adjacent sides of the box end's opening is 210 degrees.

19. The horizontal boring system of claim 9 wherein the pin end and the box end of the outer member are correspondingly threaded for torque-transmitting connection to adjacent outer members.

20. The pipe section of claim 1 in which the box end opening of the inner member has the shape of an 18-sided polygon.

21. The pipe section of claim 1 in which one or more of the plurality of sides of the box end opening are curved.

22. The pipe section of claim 1 in which the pin end is rotatable about a non-zero, central angle of 30 degrees or less within the box end of the identical adjacent inner member.

23. The pipe section of claim 1 in which the shape of the box end opening of the inner member is defined by the profile formed by a pair of regular hexagons with a common center that have been rotated out of alignment by a nonzero, central angle of 30 degrees or less and in which the profile includes the arc defined by the vertices of the hexagons as they rotate about the central angle.

* * * * *